US006014122A

United States Patent [19]

Hashimoto

[11] Patent Number: 6,014,122

[45] Date of Patent: Jan. 11, 2000

[54] LIQUID CRYSTAL DRIVING CIRCUIT FOR DRIVING A LIQUID CRYSTAL DISPLAY PANEL

[75] Inventor: Yoshiharu Hashimoto, Tokyo, Japan

[73] Assignee: NEC Corporation, Tokyo, Japan

[21] Appl. No.: 09/006,594

[22] Filed: Jan. 13, 1998

[30] Foreign Application Priority Data

Jan. 16, 1997 [JP] Japan ..... 9-005730

[51] Int. Cl.[7] ..... G09G 3/36; G09G 5/10

[52] U.S. Cl. ..... 345/98; 345/100; 345/147

[58] Field of Search ..... 345/87, 89, 98, 345/100, 147

[56] References Cited

U.S. PATENT DOCUMENTS

| | | | |
|---|---|---|---|
| 5,061,920 | 10/1991 | Nelson | 340/784 |
| 5,343,221 | 8/1994 | Arkawa et al. | 345/87 |
| 5,528,296 | 6/1996 | Erhart et al. | 345/87 |
| 5,680,149 | 10/1997 | Koyama et al. | 345/98 |
| 5,796,379 | 8/1998 | Enomoto et al. | 345/98 |

FOREIGN PATENT DOCUMENTS 63-304229 12/1988 Japan .

*Primary Examiner*—Richard A. Hjerpe
*Assistant Examiner*—Duc Dinh
*Attorney, Agent, or Firm*—Whitham, Curtis & Whitham

[57] ABSTRACT

A liquid crystal driving circuit including a switched capacitor circuit 15 having a pair of operational amplifiers AMP1 and AMP2 having different reference voltages, and an output selection circuit 16 for switch-controlling the respective outputs of the operational amplifiers AMP1 and AMP2 to output at a pair of output terminals. Positive and negative output voltages which are in positive and negative amplitude relationship with each other with a half of the liquid crystal driving voltage or the voltage of the common electrode of the liquid crystal display device as a reference voltage are alternately output from the pair of output terminals of the output selection circuit 16 to the common electrode of the liquid crystal display device, thereby performing an alternating current driving operation of the liquid crystal display device in accordance with video data.

12 Claims, 9 Drawing Sheets

FIG.6A
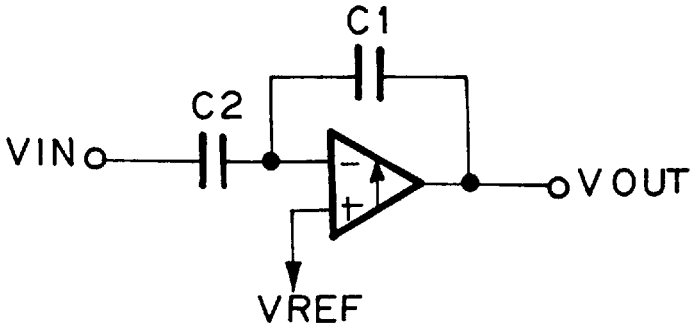
FIG.6B
$$VOUT = \left(1 + \frac{C2}{C1}\right) \cdot VREF - \frac{C2}{C1} \cdot VIN$$
FIG.6C
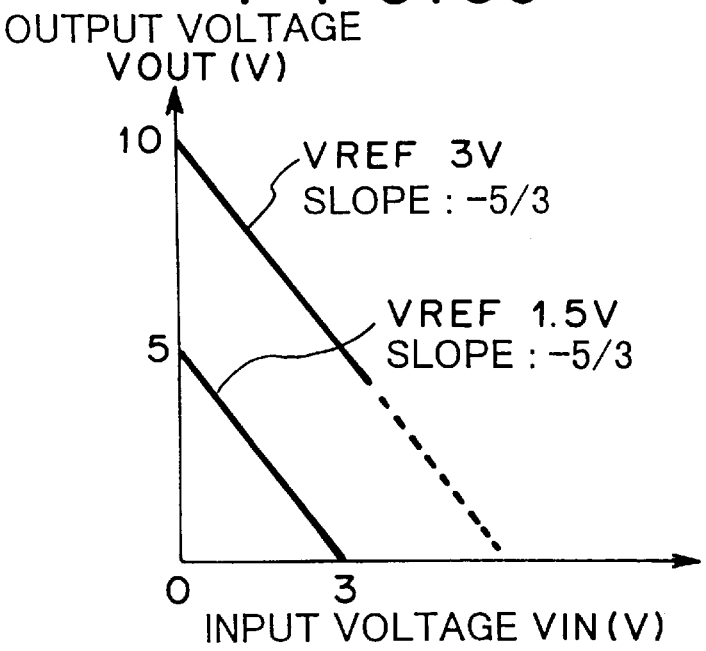

12
DATA LATCH CIRCUIT
POL
STB
18
TIMING CONTROL CIRCUIT
15' SWITCHED CAPACITOR CIRCUIT
GRADATION SELECTION CIRCUIT
14'
8
STB'
POL'
16 OUTPUT SELECTION CIRCUIT
GRADATION VOLTAGE GENERATING CIRCUIT
DECORDER
13
17'
142'
V0
V1
V254
V255
SW1
SW5
C1
C2
AMP1
AMP2
VREF1
VREF2
SW3
SW4
Y1
Y2
Y3
Y4

| LSB1 | LSB2 | LSB3 | Q |
|---|---|---|---|
| 0 | 0 | 0 | VX1 |
| 1 | 0 | 0 | VX2 |
| 0 | 1 | 0 | VX3 |
| : | : | : | : |

LIQUID CRYSTAL DRIVING CIRCUIT FOR DRIVING A LIQUID CRYSTAL DISPLAY PANEL

BACKGROUND OF THE INVENTION

1. Field of the Invention

The present invention relates to a liquid crystal driving circuit for driving a matrix type liquid crystal display panel and a liquid crystal display device.

2. Description of the Related Art

A liquid crystal driving circuit which comprises a semiconductor integrated circuit and serves to apply a video signal to a liquid crystal display device is manufactured by using a voltage-withstanding diffusion process of 10V or more in withstanding voltage. This is because when a liquid crystal panel is driven, positive and negative voltages must be alternately applied to the common electrode of the liquid crystal, that is, an alternating current driving operation must be performed on the liquid crystal panel in order to prevent deterioration of the liquid crystal.

FIG. 10 shows a conventional liquid crystal driving circuit disclosed in Japanese Laid-open Patent application No. Sho-63-304229. Referring to FIG. 10, the liquid crystal driving circuit is constructed by a semiconductor integrated circuit, and comprises a shift register circuit group 21 input a crystal clock signal XCL and a start clock pulse signal XSP, a data register circuit group 22 for latching video data PD1 to PD4 of n bits in parallel, a data latch circuit group 23 for latching the data of the data register circuit group 22 in accordance with a latch signal LCL, a decoder 24 for selecting gradation voltages of $2^n$ values which are input from the external on the basis of the video data of n bits, a level shift circuit group 25, and analog switches 26 of $2^n$. Each output terminal selects one value from the gradation voltages of $2^n$ values by the analog switch to apply a prescribed voltage to the liquid crystal panel. In order to perform an alternating current driving operation, the gradation voltage input from the external is varied every line or every frame.

The liquid crystal driving circuit alternately applies positive and negative voltages to the common electrode of the liquid crystal panel as described above, and thus a withstanding voltage which is two times or more as high as the threshold voltage of a liquid crystal driving thin film transistor TFT of the liquid crystal panel is required. Specifically, the threshold voltage of the liquid crystal TFT is usually equal to about 4 to 5 V, and thus in order to perform the alternating current driving operation, the liquid crystal driving circuit is manufactured by using the diffusion process having a high withstanding voltage of 10 V or more.

However, the conventional liquid crystal driving circuit has the following problems containing the above case.

As a first problem, when it is constructed by a semiconductor integrated circuit, the chip size is necessarily large. This is because the number of analog switches increases as the gradation number increases. For example, in the case of 8 bits of digital image data, 256 analog switches are required to each output. Further, since the load of a liquid crystal data line is increased (above 100 pF) and a liquid crystal writing time must be shortened (in the case of VGA of 640×480 pixels, the horizontal period is equal to about 30 êEsec, however, in the case of XGA of 1028×768 pixels is reduced to about 16 êEsec), the on-resistance of the switch is required to be lowered, and thus the transistor size must be large.

As a second problem, the power consumption is high. This is because n level shift circuits must be provided for each output and they need large current consumption. Usually, the level shift circuit has a disadvantage that the operation speed thereof is lower than other logic circuits and a transit current is very large. For example, in the case of 384 output terminal numbers and 256 gradations (8 bits), a transit current of 1mA flows in one level shift circuit, and thus a transit current of 384×8×1 mA=3.72A flows at maximum. Therefore, if the wiring resistance is high, the voltage drop would be large and some trouble may occur in the operation.

SUMMARY OF THE INVENTION

An object of the present invention is to provide a liquid crystal driving circuit which can be constructed by a s semiconductor integrated circuit having a small chip size, and a liquid crystal display device using the liquid crystal driving circuit.

Another object of the present invention is to provide a liquid crystal driving circuit having a lower power consumption.

According to the present invention, a liquid crystal driving circuit comprises a switched capacitor circuit containing a pair of operational amplifiers having different reference voltages, and an output selection circuit for performing switch control on each output of the pair of operational amplifiers and outputting the switch-controlled result from a pair of output terminals, wherein positive and negative output voltages which are in positive and negative amplitude relationship with each other with a half voltage of a liquid crystal driving voltage as a reference voltage are alternately output from the pair of output terminals of the output selection circuit to the common electrode of the liquid crystal display device to perform an alternating current driving on the liquid crystal display device in accordance with video data.

Further, according to the present invention, a liquid crystal driving circuit comprises a switched capacitor circuit containing a pair of operational amplifiers having different reference voltages, and an output selection circuit for performing switch control on each output of the pair of operational amplifiers and outputting the switch-controlled result from a pair of output terminals, wherein positive and negative output voltages which are in positive and negative amplitude relationship with each other with the voltage of the common electrode of the liquid crystal display as a reference voltage are alternately output from the pair of output terminals of the output selection circuit to the common electrode of the liquid crystal display device to perform an alternating current driving on the liquid crystal display device in accordance with video data.

Still further, according to the present invention, the liquid crystal driving circuit further includes a gradation selection circuit for selecting a gradation voltage in accordance with the video data and outputting the selected gradation voltage to the switched capacitor circuit, wherein the gradation selection circuit comprises analog switches the number of which corresponds to the number of gradations, the selected gradation voltage being set as a reference voltage of the two operational amplifiers of the switched capacitor circuit.

BRIEF DESCRIPTION OF THE DRAWINGS

FIGS. 6A to 6C are diagrams showing the operation of a switched capacitor circuit in the liquid crystal driving circuit shown in FIG. 2;

DETAILED DESCRIPTION OF THE PREFERRED EMBODIMENTS

Preferred embodiments of the present invention will be described hereunder with reference to the accompanying drawings.

First Embodiment

Figure 1:
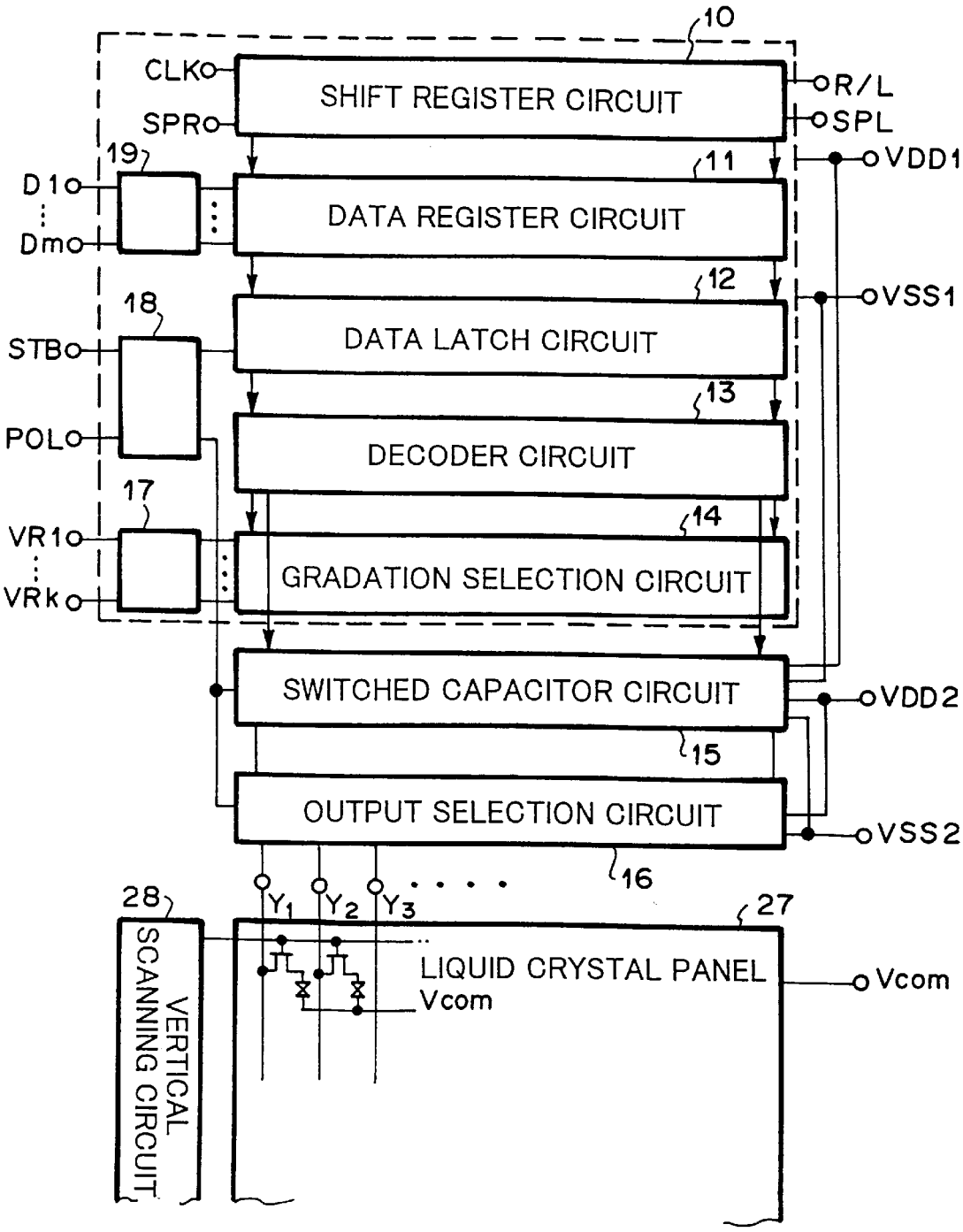
FIG. 1 is a diagram showing the construction of a liquid crystal driving circuit according to a first embodiment of the present invention.
Figure 2:
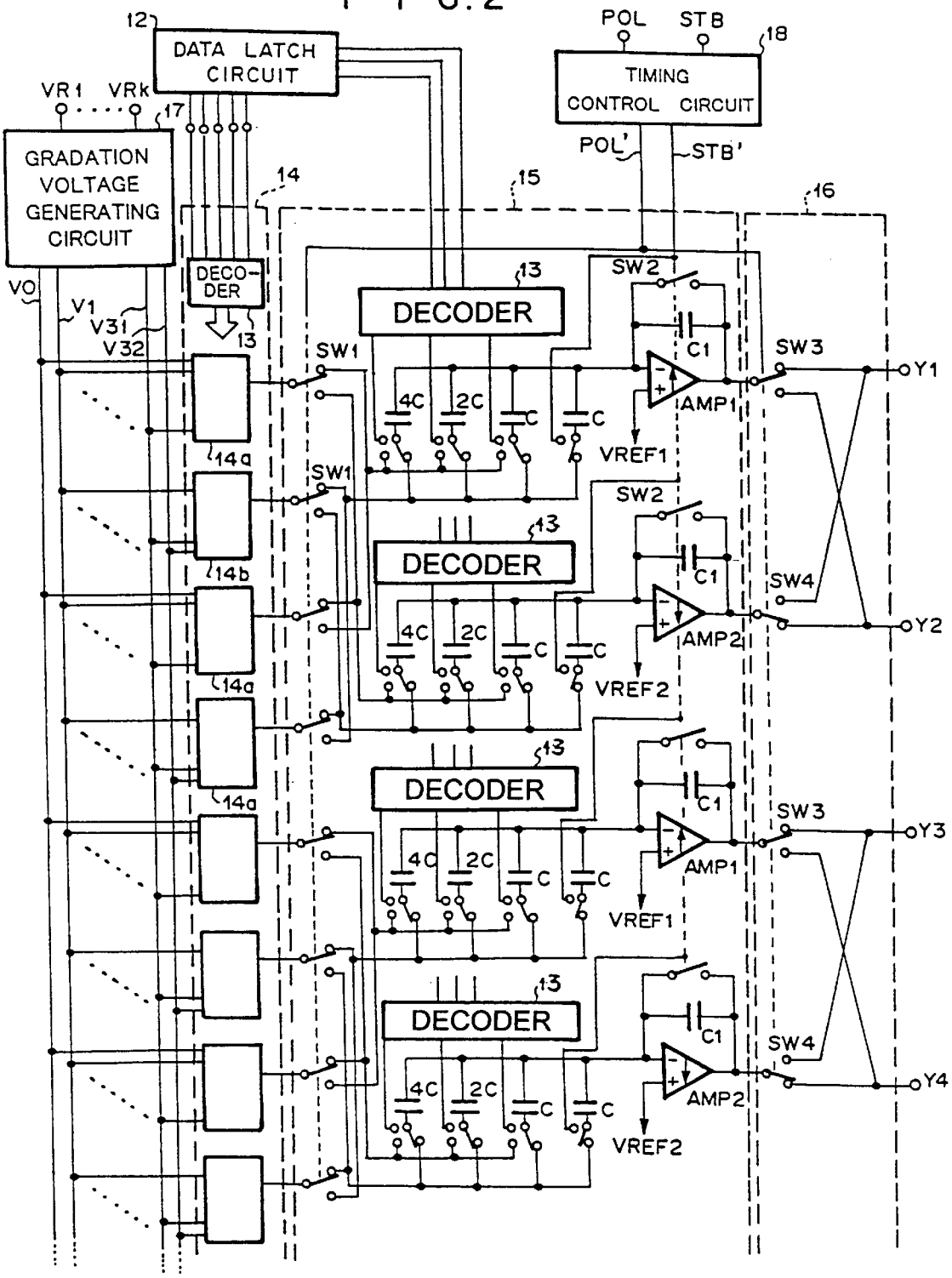
FIG. 2 is a diagram showing the construction of the main part of the liquid crystal driving circuit; shown in FIG. 1.
Figure 3:
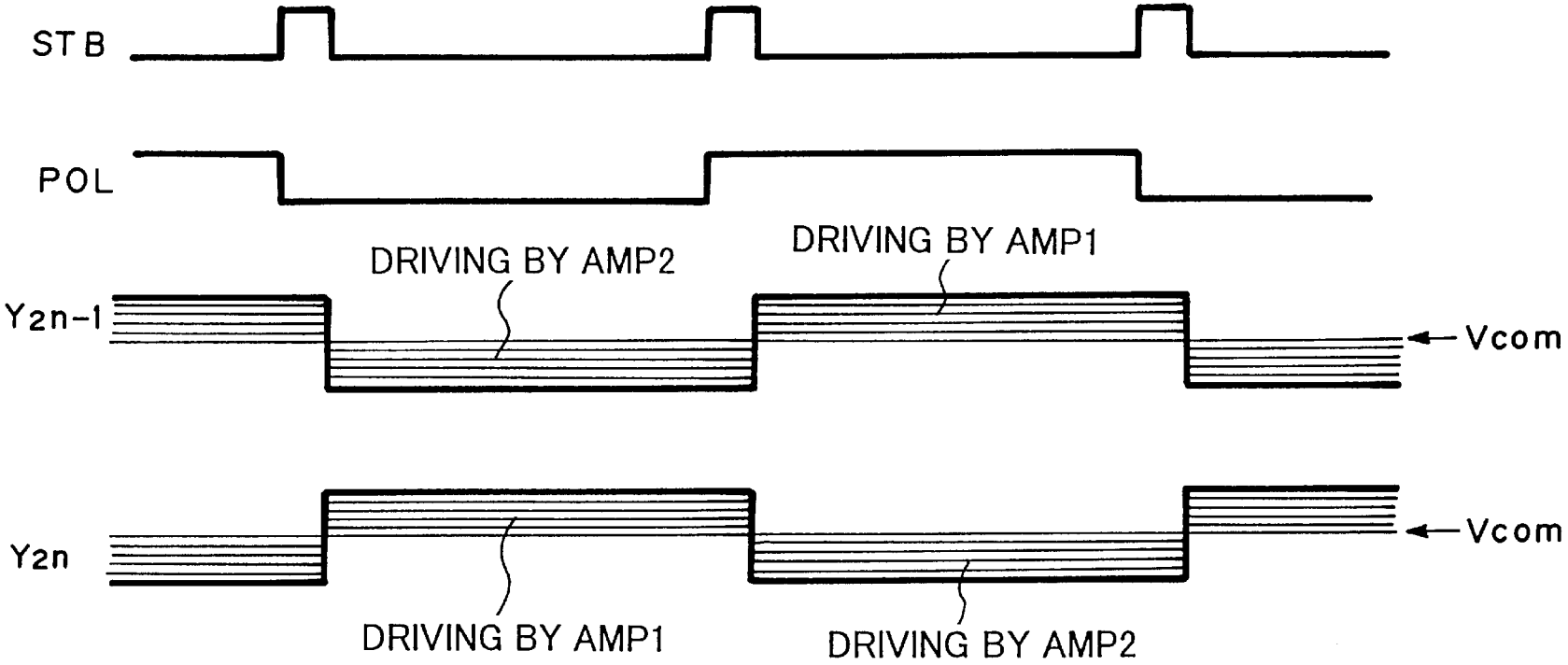
FIG. 3 is a timing chart showing the operation of the liquid crystal driving circuit shown in FIG. 1.

FIG. 1 is a diagram showing the overall construction of a liquid crystal driving circuit according to a first embodiment of the present invention. FIG. 2 is a circuit diagram showing the main part of the liquid crystal driving circuit shown in FIG. 1, and FIG. 3 is a timing chart showing the operation of the liquid crystal driving circuit shown in FIG. 1.

Referring to FIG. 1, the liquid crystal driving circuit according to the first embodiment includes a shift register circuit 10, a data register circuit 11, a data latch circuit 12, a decoder circuit 13, a gradation selection circuit 14, a switched capacitor circuit 15 containing an output amplifier, an output selection circuit 16, a gradation voltage generating circuit 17, a timing control circuit 18, a data buffer circuit 19, a liquid crystal panel 27 serving as a liquid crystal display device, and a vertical scanning circuit 28.

The voltage to be applied to each circuit is set as follows. The voltage VSS1 at the low potential side of each of all the circuits is set as follows: VSS1=VSS2=0. Further, the voltage VDD1 at the high potential side of the shift register circuit 10, the data register circuit 11, the data latch circuit 12, the decoder circuit 13, the data buffer circuit 19, the timing control circuit 18, a part of the switched capacitor circuit 15 and the gradation voltage generating circuit 17 is set as follows: VDD1=3.0 V. The voltage VDD2 at the high potential side of the operational amplifier and the output selection circuit 16 is set as follows: VDD2=10 V. Further, the common electrode voltage VCOM of the liquid crystal display device 27 is set to 5 V. However, each voltage as described above is an example value, and thus other voltages may be set.

Next, the operation of the liquid crystal driving circuit of this embodiment will be described in the case where the video signal is composed of 8 bits with reference to FIGS. 1 to 3.

When a start pulse signal SPR or SPL is input to the shift register circuit 10, video signals D1 to Dm are successively transferred to and held in the data register circuit 11 at each output in synchronism with the clock signal by the shift register circuit 10. The data thus held are is transferred to and held in the data latch circuit 12 at the rise-up time of a latch signal STB to the timing control circuit 18 (see FIG. 3), and then transferred to the decoder circuit 13 at the subsequent stage. With respect to the data, the upper 5 bits of the 8-bit video signals are used to set an upper reference voltage and a lower reference voltage on the switched capacitor circuit 15 at the subsequent stage by selecting one value from 32 voltage values (represented by 5 bits) in the gradation selection circuit shown in FIG. 5.

Further, the residual lower 3 bits are used to select one value from 8 voltage values (represented by 3 bits) in the switched capacitor circuit 15, and apply a predetermined voltage to the common electrode of the liquid crystal display device (not shown) from the output terminals Y1, Y2, . . . , Y2n−1, Y2n at the falling time of the latch signal STB to the timing control circuit 18.

Next, the construction and the operation of the liquid crystal driving circuit will be described in more detail.

Figure 4:
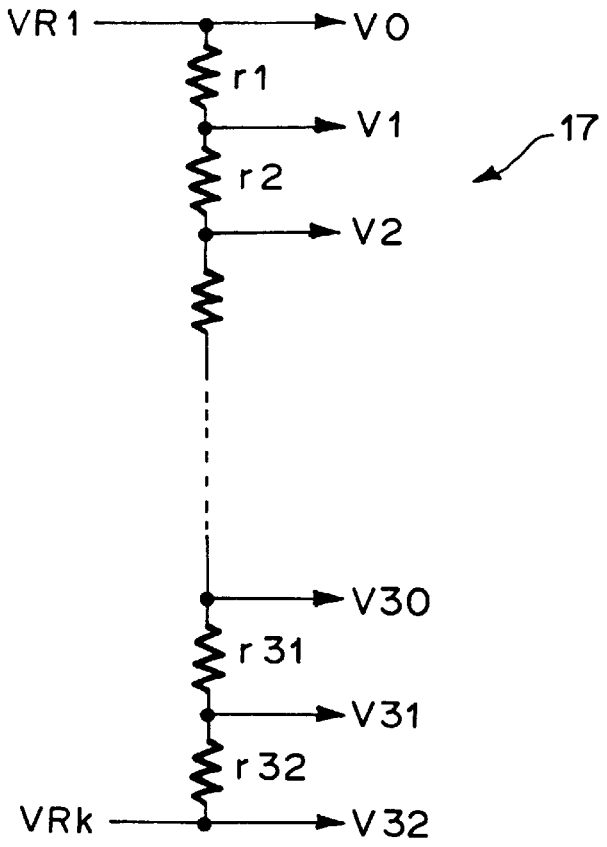
FIG. 4 is a diagram showing the construction of a gradation voltage generating circuit in the liquid crystal driving circuit shown in FIG. 1.

FIG. 4 is a circuit diagram showing the detailed construction of the gradation voltage generating circuit 17. The gradation voltage generating circuit 17 comprises a resistance strings circuit, etc., and it divides the liquid crystal reference voltages VR1 to VRk supplied from the external by using voltage-dividing resistors to generate gradation values of 32 values (V1, V2, . . . , V32). FIG. 4 shows a case where two liquid crystal reference voltages (VR1, VRk) are supplied, however, plural levels of voltages (reference voltages VR1 to VRk) may be supplied to generate and supply more finely divisional voltages.

When the liquid crystal display device 27 to which the liquid crystal driving circuit of the present invention is applied comprises TFTs (Thin Film Transistor), with respect to the reference voltage value supplied from the external of the gradation voltage generating circuit 17, the shift amount of charges when the TFT is switched off is varied in accordance with the voltage input thereto, and thus it is preferable that the gradation voltage generating circuit 17 comprises two systems to make the liquid crystal reference voltage VRk supplied from the external different between the positive output terminal and the negative output terminal. The gradation voltage generating circuit 17 needs a high relative precision. When it is produced by semiconductors, a relative precision of 16 bits or more can be obtained. Therefore, if a relative precision of 5 to 8 bits is required, the circuit 17 can easily satisfy the requirement for the relative precision.

Figure 5:
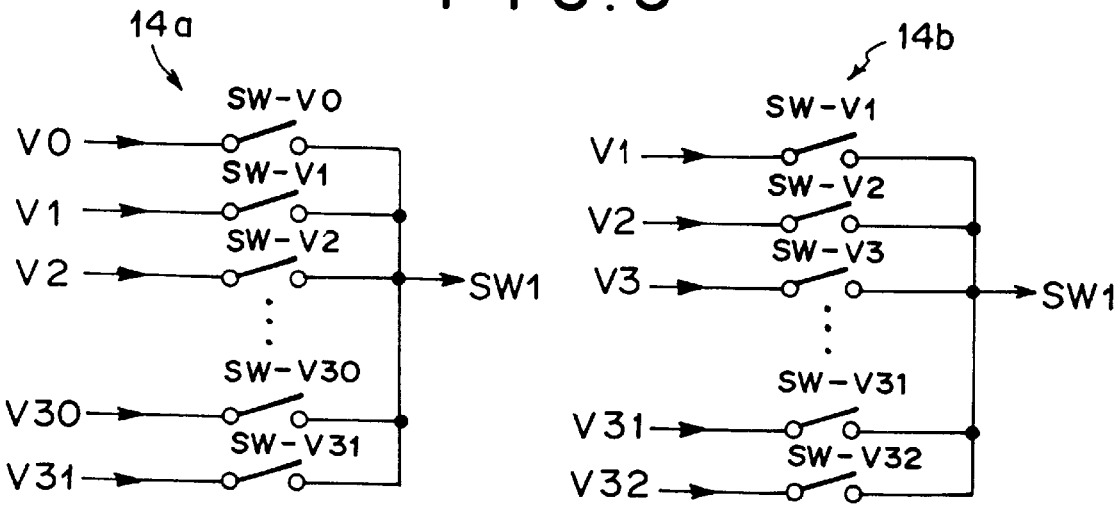
FIG. 5 is a diagram showing the construction of the gradation selection circuit in the liquid crystal driving circuit shown in FIG. 1.

FIG. 5 is a circuit diagram showing the detailed construction of the gradation selection circuit 14*a* and 14*b*, and shows the content of each block shown in the gradation selection circuit 14*a* and 14*b* shown in FIG. 2. The gradation selection circuit 14*a* and 14*b* comprises 32 switches (analog switches) respectively.

The gradation selection circuit 14*a* selects one value from voltages V0 to V31 of the gradation voltage generating circuit 17 on the basis of the data of upper 5 bits of 8 bits in the video signals D1 to Dm, and sets the selected value (voltage) as a upper reference voltage of the switched capacitor circuit 15.

The gradation selection circuit 14*b* selects one value from voltages V1 to V32 of the gradation voltages generating circuit 17 on the basis of the data of upper 5 bits of 8 bits in the video signals D1 to Dm, and sets the selected value (voltage) as a lower reference voltage of the switched capacitor circuit 15.

Here, every two parts of the gradation selection circuit 14*a* and 14*b* are provided for each output by the switch at the connection portion between the gradation selection circuit 14*a* and 14*b* and the switched capacitor circuit 15, and these are supplied as the upper reference voltage and the lower reference voltage. The upper reference voltage is set as a reference voltage when a positive-side voltage is applied to a liquid crystal panel 27, and the lower reference voltage is set as a reference voltage when a negative-side voltage is applied. For example, the selection is made so that when the upper reference voltage is V1, V2, V3, . . . , V31, the lower reference voltage is V1, V2, V3 . . . , V32.

Next, the switched capacitor circuit 15 and operational amplifiers AMP1, AMP2 contained in the switched capacitor circuit 15 will be described. The switched capacitor circuit 15 will be described with reference to FIGS. 6A to 6C.

The basic circuit construction of each operational amplifier AMP1, AMP2 in the switched capacitor circuit 15 is shown in FIG. 6A. In the circuit shown in FIG. 6A, the relationship between the input voltage VIN and the output voltage VOUT is expressed by an equation shown in FIG. 6B and a graph shown in FIG. 6C. According to FIG. 2, the capacitor C2 is varied from 1C to 8C on the basis of a switching operation in accordance with 3 bits supplied from the decoder circuit 13 (i.e., as shown in FIG. 2, capacitors of 1C to 4C are multiplexed in accordance with 3 bits from the decoder circuit 13, and the capacitor thus multiplexed corresponds to the capacitor C2 shown in FIG. 6A and varies from 1C to 8C (8C corresponds to the total capacitance of all the capacitors).

Now, the AMP1, AMP2 will be described on the assumption that the capacitance between the input and the output of the amplifier AMP1, AMP2 is set as C1.

The reference voltage value VIN of the switched capacitor circuit 15 is supplied from the gradation selection circuit 14*a* and 14*b*, and it ranges from 0 to 3 V because the voltage at the high potential side supplied (VDD1) is equal to 3 V.

In order to output the positive-side voltage of 5 to 10 V to the common electrode voltage VCOM=5 of the liquid crystal display device, the capacitor ratio of the switched capacitor circuit 15 may be set to C2/C1=⅝, and the non-inversion input voltage of the operational amplifier AMP1 (VREF) may be set to 3.75 V to obtain the desired output voltage range. Further, at the case, the capacitor C1 between input terminal and output terminal of the operational amplifier AMP1 is (⅜)8C, and the capacitor 4C, 2C and C is switched according to the decoder 13, for example, when the outputs "000" of the decoder 13 is added, as shown in FIG. 2, the capacitor 7C+C are added to input terminal of the operational amplifier AMP1 as the lower reference voltage. Further, when the outputs "111" of the decoder 13 is added, the capacitor 7C+C are added to input terminal of the operational amplifier AMP1 as the upper reference voltage.

Likewise, in order to output the negative-side voltage 0 V to 5 V, the capacitor ratio of the switched capacitor circuit 15 my be set to C2/C1=⅝, and the non-inversion input voltage of the operational amplifier AMP2 (VREF2) may be set to 1.875 V.

Further, in the case of VDD2=8 V and VCOM=4 V, if VIN is set to 0 to 2.4 V and VREF1 is set to 3.0 V, the positive-side output range of 4 to 8 V is obtained, and if VIN is set to 0 to 2.4 V and VREF2 is set to 1.5 V, the negative-side output range of 0 to 4 V is obtained.

As described above, the non-inversion input voltages VREF1 and VREF2 of the operational amplifiers and the liquid crystal reference voltages VR1 to VRn can be controlled from the external, so that the positive and negative output voltage ranges for driving the liquid crystal display device can be easily controlled. It is sufficient to set the absolute precision of the reference voltage of the operational amplifier to about (8+1) bits, and this precision can be implemented by a DC-DC converter soled in the market.

Next, the operation of the liquid crystal driving circuit will be described with reference to FIGS. 2 and 3.

The latch signal STB which is an input signal to the timing control circuit 18 is an off-state (Hi-z) of H state, the switch SW1 of the input portion of the switched capacitor circuit 15 is off state in a state shown in FIG. 2, the switch SW3 between the operational amplifier AMPl and AMP2 of the switched capacitor circuit 15 and the output selection circuit 16 is off state. At this time, the switch SW2 between the inversion input terminal and the output terminal of the operational amplifier AMP1 and AMP2 is switched on state and odd outputs are reset to the non-inversion input voltage VREF1 while the even outputs are reset to VREF2.

When a polarized signal POL changes to H state and the latch signal STB is switched to L (low state), the voltages which are selected by the upper 5 bits of the video signal in the gradation selection circuit 14*a* and 14*b* are applied to the switch SWl of the input portion of the switched capacitor circuit 15 as the upper reference voltage VREF1 and the lower reference voltage VREF2 of the two operational amplifiers AMP1 and AMP2 respectively of the switched capacitor circuit 15, and the state is shown in FIG. 2. At this time, the switched capacitor circuit 15 selects, on the basis of the lower 3 bits of the video signal, the on/off of the switch of the plural capacitors 4C, 2C, C, C which are connected to the non-inversion terminals of the operational amplifiers, and selects and outputs the voltage corresponding to the digital data of the video signal. Here, the lower 3 bits from the decoder circuit 13 are converted to four switch control signals by plural decoders in the switched capacitor circuit 15 to perform the switching operation of the switches of the capacitors 4C, 2C, C, C.

Figures 11A, 11B:
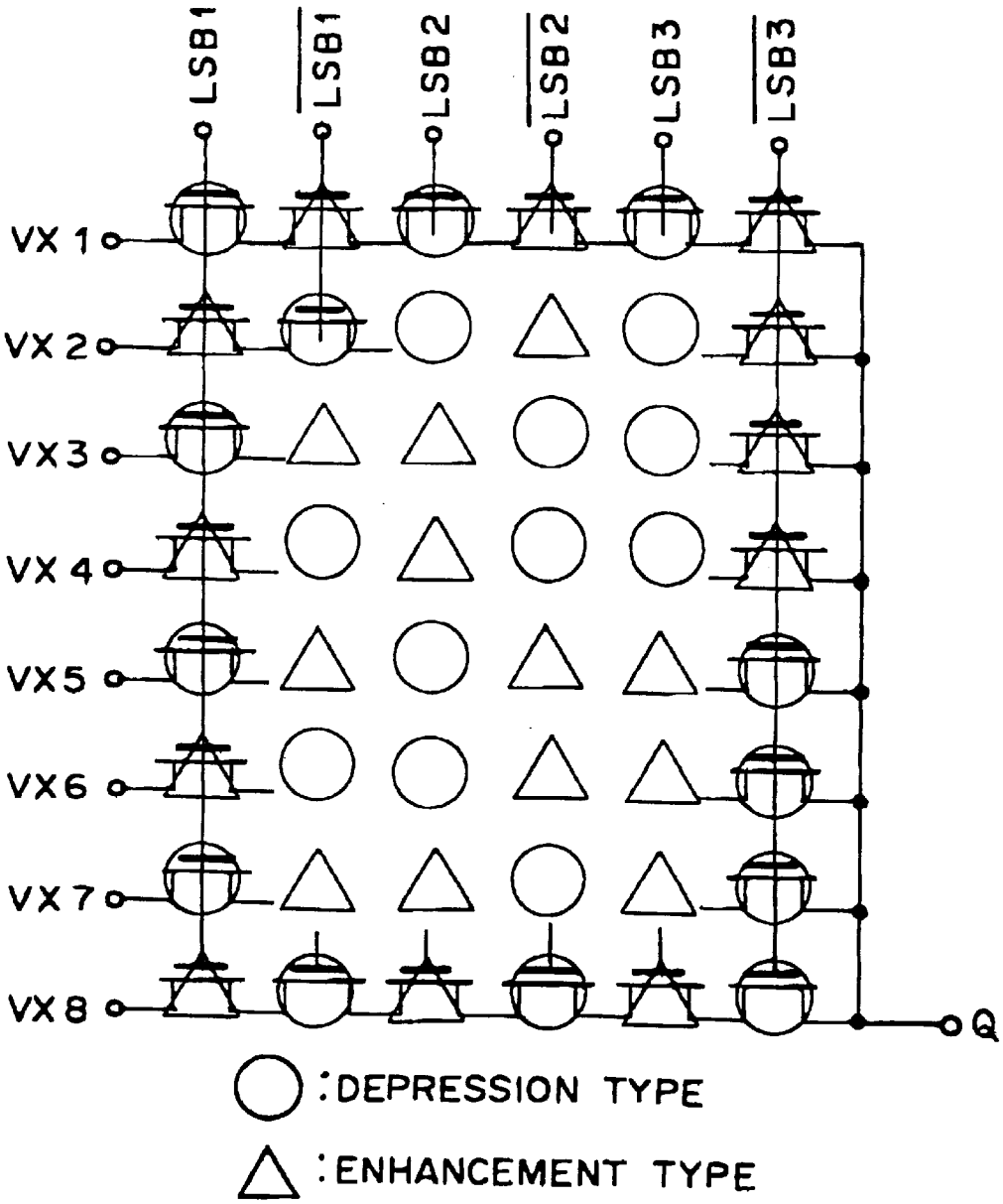
FIGS. 11*a* and 11*b* are a diagram showing the construction of a data latch circuit directly to switched capacitor circuit and a diagram showing the example format.

Each decoder 13 of the gradation selection circuit 14*a* and 14*b* and the switched capacitor circuit 15 in FIG. 2, may be omitted by constructing the decoder circuit 13 by depression type and enhanced type MOS transistors matrix switchers in shown FIGS. 11*a* and 11*b*, and directly controlling the switches in the gradation selection circuit 14*a* and 14*b* and the switched capacitor circuit under the control of the decoder circuit 13. As shown FIG. 11*a*, input terminal LSB1 to LSB3 are input from the data latch circuit 12, and input terminal vx1 to vx8 are input from the gradation voltage generating circuit 17. That is, output terminal v0 to v32 of the gradation voltage generating circuit 17 are connected to left side terminal in FIG. 11*a*. Output terminal Q as shown in FIG. 11*a* is connected to input terminal of the switched capacitor circuit 15. For example, if LSB1=0, LSB2=0 and LSB3=0, output terminal Q output a value vx1. Further, if LSB1=0, LSB2=1 and LSB3=0, output terminal Q output a value vx3 as shown in FIG. 11*b*. Therefore, in this case, the decoder circuit 13 is not needed for taking place to the matrix switcher. The data latch circuit 12 directly connects to the gradation selection circuit 14*a* and 14*b* and the switched capacitor circuit 15.

When a polarity signal POL supplied from the timing control circuit 18 is in H state, the output selection circuit 16 operates to output the positive-side voltage to the liquid crystal common electrode voltage VCOM of the liquid crystal display device 27 through the odd output terminals from the operational amplifier AMP1. The negative-side voltage is output from the operational amplifier AMP2 through the even output terminals to VCOM. On the other hand, when the polarity signal POL is in L state, the negative-side volt-age is output from the operational amplifier AMP2 through the odd output terminals to the liquid crystal common electrode voltage VCOM. The negative-side voltage is output from the operational amplifier AMP1 through the even output terminal to VCOM. The output terminals of the operational amplifiers are kept in the previous state for a period of the H-state of the latch signal STB from the time when the polarity signal POL is inverted to L state. As described above, the operational amplifiers of the two systems are commonly used at the two terminals, and the switching control is performed so as to output the positive and negative voltages time-sequentially, thereby performing the alternating current driving operation of the liquid crystal display device.

Figure 7:
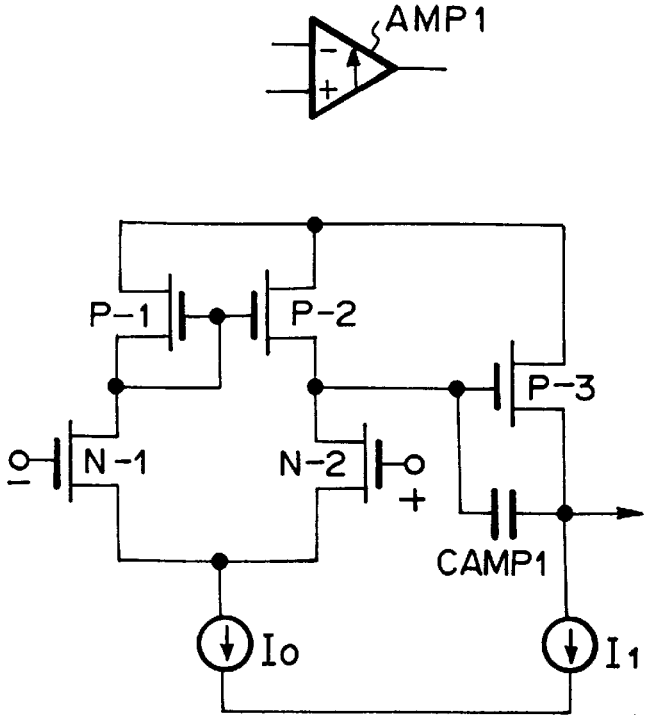
FIG. 7 is a circuit diagram showing the inner construction of an operational amplifier contained in the switched capacitor circuit of the liquid crystal driving circuit shown in FIG. 2.
Figure 8:
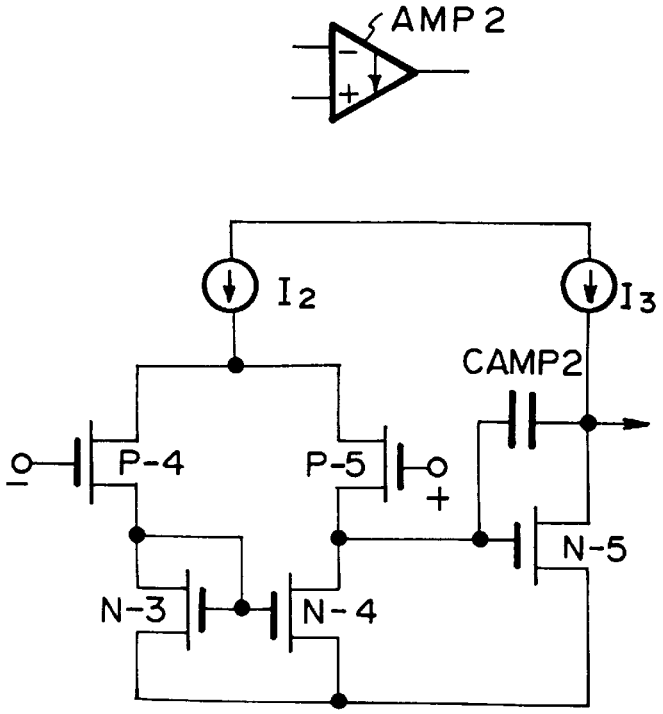
FIG. 8 is a circuit diagram showing the inner construction of the operational amplifier contained in the switched capacitor circuit of the liquid crystal driving circuit shown in FIG. 2.

Next, FIGS. 7 and 8 show the inner constructions (as indicated by arrows in the operational amplifiers of FIG. 2) of the operational amplifiers AMP1 and AMP2 in FIG. 2 respectively. The operational amplifier AMP1 comprises an MOS type amplifier having a differential input stage N–1 and N–2, a current mirror P–1 and P–2 serving as a load on the differential input stage N–1 and N–2, an output stage P–1 for inputting one output of the differential input stage and a phase compensation capacitor CAMP1. The operational amplifier AMP2 comprises an MOS type amplifier having a differential input stage P–4 and P–5, a current mirror N–3 and N–4 serving as a load on the differential input stage P–4 and P–5, an output stage N–5 for inputting one output of the differential input stage and a phase compensation capacitor CAMP2.

In the liquid crystal driving circuit, operational amplifiers having different types of differential input stages are used. When a positive voltage to the liquid crystal common electrode voltage VCOM is output, the positive voltage can be output at maximum to the high potential side by setting the transistor of the differential input stage N–1 and N–2 to Nch as shown in FIG. 7. Further when a negative voltage to the liquid crystal common electrode voltage VCOM is output, the negative voltage can be output at maximum to the low potential side by setting the transistor of the differential input stage P–4 and P–5 to Pch as shown in FIG. 8. The operational amplifiers of these two systems re-commonly used, and subjected to the switching control, whereby the alternating current driving operation of the liquid crystal can be performed in a broad dynamic range.

Second Embodiment

Next, a liquid crystal driving circuit according to a second embodiment of the present invention will be described.

Figure 9:
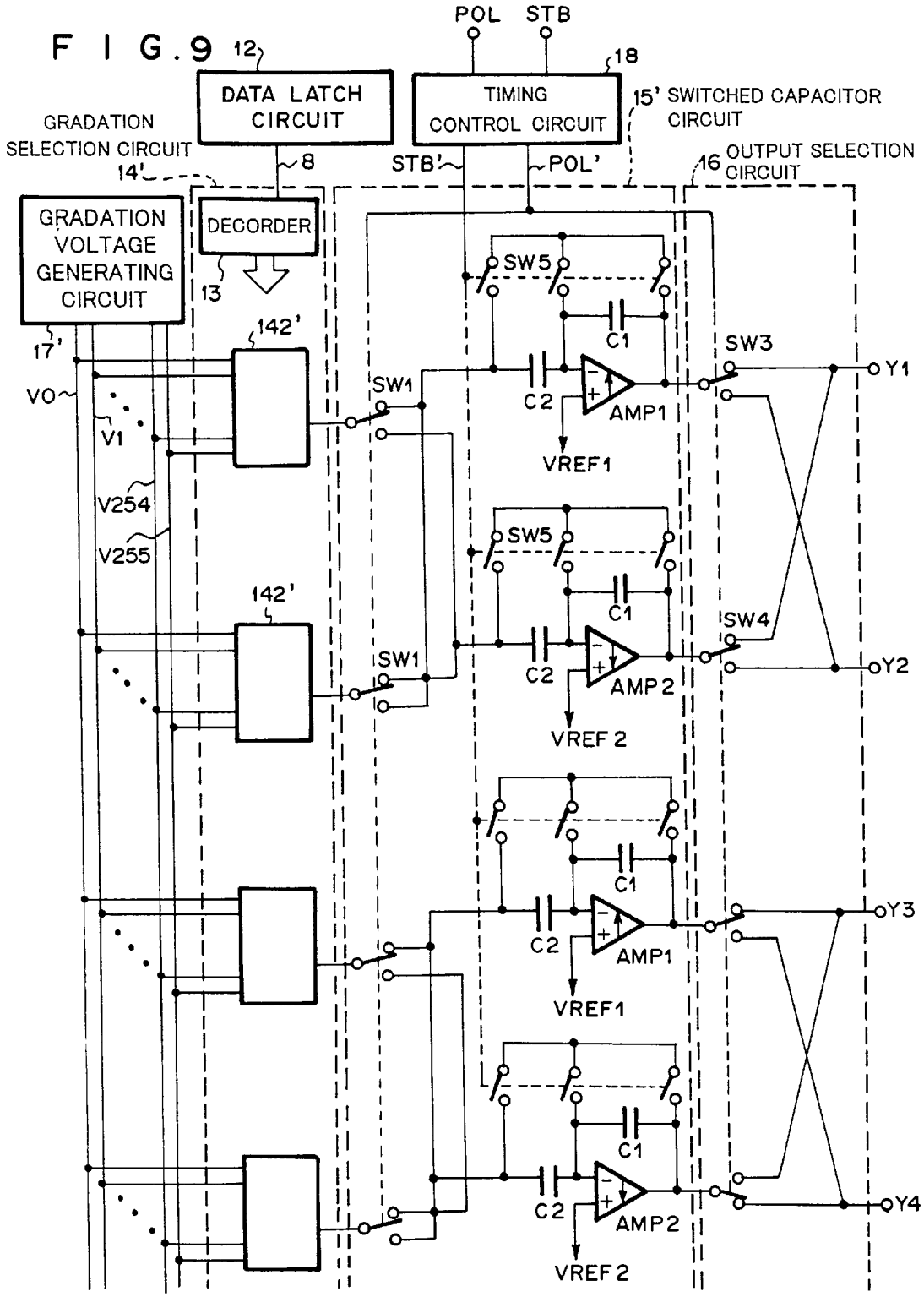
FIG. 9 is a diagram showing the main part of a liquid crystal driving circuit according to a second embodiment of the present invention.
Figure 10:
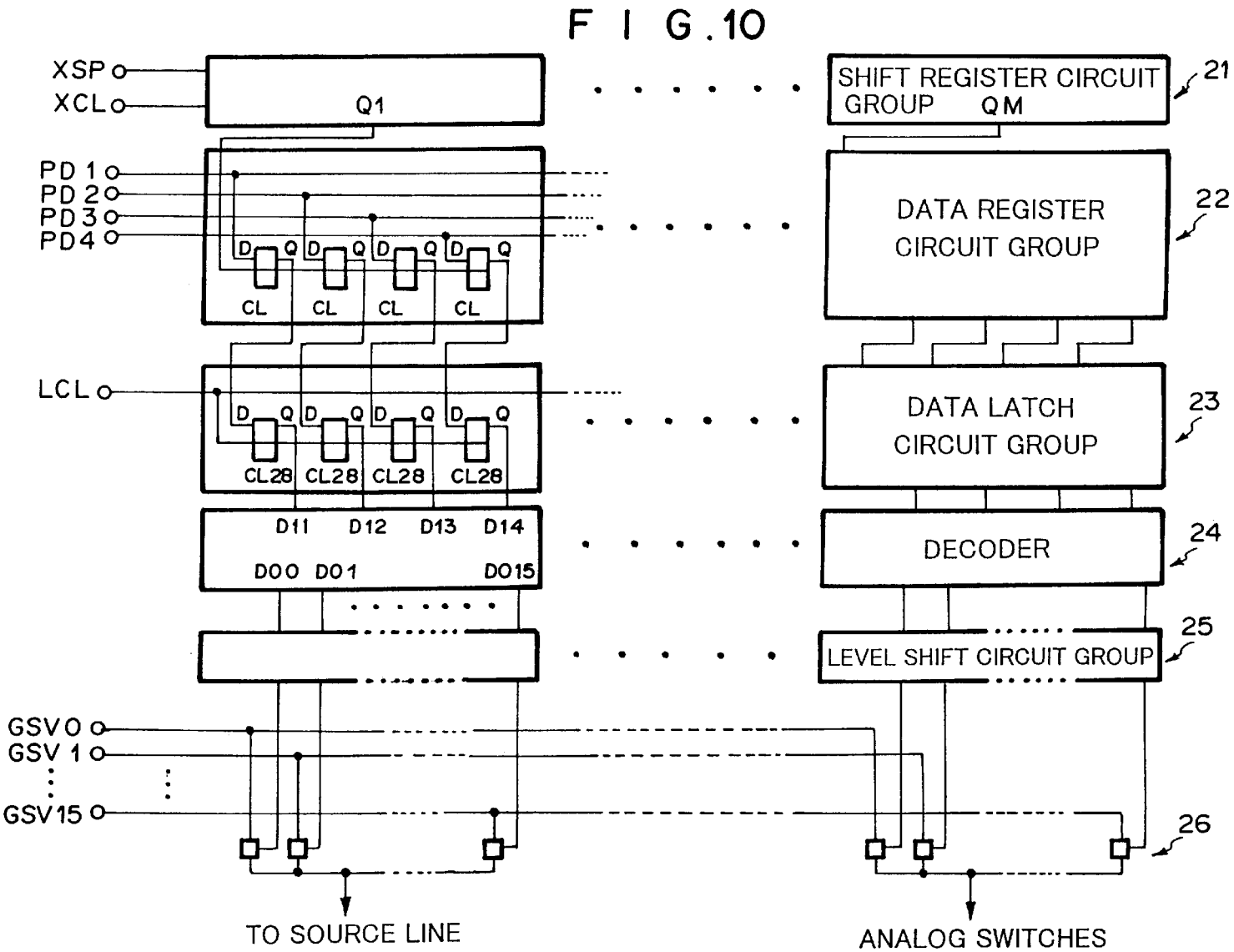
FIG. 10 is a diagram showing the construction of a conventional liquid crystal driving circuit.

FIG. 9 is a diagram showing the main part of the liquid crystal driving circuit according to the second embodiment of the present invention.

Referring to FIG. 9, the liquid crystal driving circuit of the embodiment is different from the first embodiment in the construction of a gradation selection circuit 14' and a switched capacitor circuit 15'. The gradation selection circuit 14' has 256 analog switches (corresponding to 8 bits) to the 5-bit input shown in FIG. 2, and selects only one value from 256 values to set the selected value as a reference voltage of the switched capacitor circuit 15'. The non-inversion input voltages VREF1, VREF2 of the operational amplifiers in the switched capacitor circuit 15' may be set to the same voltages as the first embodiment, however, the operational amplifiers serve as so-called inversion amplifiers. In the switched capacitor circuit 15', the output voltage corresponding to the switched capacitor is obtained at each of the positive and negative sides by the circuit shown in FIG. 6A through a switch for sharing the reference voltage from the gradation selection circuit 14' to the odd-number and even-number signals lines of the liquid crystal panel, and then output to the odd-numbered and even-numbered signals lines of the liquid crystal panel 27 from the output selection circuit 16.

The merit of the second embodiment resides in that there is a monotone increase. This is because the voltage is selected for all the video data by the resistance strings circuit and thus there is no bit error in the switched capacitor circuit 15'. However, the demerit of this embodiment resides in that the number of switches is equal to 64×2 (upper reference voltage, lower reference voltage)=128 for each output in the first embodiment while the number of switches in the second embodiment is twice (256) as large as the first embodiment, and thus a large chip area is needed. However, the construction of the switched capacitor circuit 15' is simpler than that of the first embodiment, and thus the chip area may be set to the same level as the first embodiment or may be smaller than the first embodiment in accordance with a unit capacitance value (1C) in the switched capacitor circuit 15'.

As described above, the liquid crystal driving circuit according to the present invention comprises a switched capacitor circuit containing a pair of operational amplifiers having different reference voltages, and an output selection circuit for performing switch control on each output of the pair of operational amplifiers and outputting the switch-controlled result from a pair of output terminals, wherein positive and negative output voltages which are in positive and negative amplitude relationship with each other with a half voltage of a liquid crystal driving voltage as a reference voltage are alternately output from the pair of output terminals of the output selection circuit to the common electrode of the liquid crystal display device to perform an alternating current driving on the liquid crystal display device in accordance with video data. Therefore, the following effect can be obtained.

The decoder circuit and the gradation selection circuit operates with a voltage of 3 V, so that the liquid crystal driving circuit of the present invention can be manufactured by the low withstanding-voltage diffusion process, and also the chip size can be designed in compact size because the transistors may be designed in small size.

Further, no level shift circuit is needed, and thus the liquid crystal driving circuit can be designed in compact size and with lower power consumption as compared with the conventional circuit. Particularly, since a large current flows transiently, the wiring width of power-source wires such as GND, etc. may be small, and thus the chip size can be further reduced.

What is claimed is:

1. A liquid crystal driving circuit comprising:

a switched capacitor circuit containing a pair of operational amplifiers having different reference voltages; and an output selection circuit for performing switch control on each output of the pair of operational amplifiers and outputting the switch-controlled result from a pair of output terminals, wherein positive and negative output voltages which are in positive and negative amplitude relationship with each other with a half voltage of a liquid crystal driving voltage as a reference voltage are alternately output from the pair of output terminals of said output selection circuit to the common electrode of the liquid crystal display device to perform an alternating current driving on said liquid crystal display device in accordance with video data.

2. The liquid crystal driving circuit as claimed in claim 1, further including a gradation selection circuit for selecting a gradation voltage in accordance with the video data and outputting the selected gradation voltage to said switched capacitor circuit, wherein said gradation selection circuit comprises analog switches the number of which corresponds to the number of gradations, the selected gradation voltage being set as a reference voltage of the two operational amplifiers of said switched capacitor circuit.

3. A liquid crystal driving circuit comprising:

a switched capacitor circuit containing a pair of operational amplifiers having different reference voltages; and an output selection circuit for performing switch control on each output of the pair of operational amplifiers and outputting the switch-controlled result from a pair of output terminals, wherein positive and negative output voltages which are in positive and negative amplitude relationship with each other with the voltage of the common electrode of the liquid crystal display as a reference voltage are alternately output from the pair of output terminals of the output selection circuit to the common electrode of the liquid crystal display device to perform an alternating current driving on the liquid crystal display device in accordance with video data.

4. The liquid crystal driving circuit as claimed in claim 3, further including a gradation selection circuit for selecting a gradation voltage in accordance with the video data and outputting the selected gradation voltage to said switched capacitor circuit, wherein said gradation selection circuit comprises analog switches the number of which corresponds to the number of gradations, the selected gradation voltage being set as a reference voltage of the two operational amplifiers of said switched capacitor circuit.

5. A liquid crystal driving circuit comprising:

a shift register which is driven on the basis a clock with a start signal as a trigger;

a data register for transferring/holding an input digital video signal by said shift register;

a gradation selection circuit for generating odd-numbered/even-numbered reference voltages on the basis of each bit data of said data register;

a switched capacitor circuit having at least two operational amplifiers for receiving the odd-numbered/even-numbered reference voltages to generate capacitor divisional voltages; and an output selection circuit for switching the outputs of said two operational amplifiers of said switched capacitor circuit to odd-numbered/even-numbered vertical signal lines of a liquid crystal panel, wherein said switched capacitor circuit has two operational amplifiers for capacitor ratio amplification which are input with the odd-numbered and even-numbered reference voltages through capacitors.

6. The liquid crystal driving circuit as claimed in claim 5, wherein each of said operational amplifiers of said switched capacitor sets a transistor at a differential input stage to an n-type channel and sets an output stage to a p-type channel when a positive-side voltage to the common voltage of said liquid crystal panel is output, and sets the transistor at the differential input stage to a p-type channel and sets the output stage to an n-type channel when a negative-side voltage to the common voltage of said liquid crystal panel is output.

7. The liquid crystal driving circuit, as claimed in claim 5, wherein said gradation selection circuit selects and outputs one value through predetermined number of switches from predetermined number of divisional voltages into which a liquid crystal reference voltage is divided by resistance division in a gradation voltage generating circuit.

8. The liquid crystal driving circuit as claimed in claim 7, wherein each of said operational amplifiers of said switched capacitor sets a transistor at a differential input stage to an n-type channel and sets an output stage to a p-type channel when a positive-side voltage to the common voltage of said liquid crystal panel is output, and sets the transistor at the differential input stage to a p-type channel and sets the output stage to an n-type channel when a negative-side voltage to the common voltage of said liquid crystal panel is output.

9. A liquid crystal display device comprising:

a shift register which is driven on the basis a clock with a start signal as a trigger;

a data register for transferring/holding an input digital video signal by said shift register;

a gradation selection circuit for generating odd-numbered/even-numbered reference voltages on the basis of each bit data of said data register;

a switched capacitor circuit having at least two operational amplifiers for receiving the odd-numbered/even-numbered reference voltages to generates capacitor divisional voltages;

an output selection circuit for switching the outputs of said two operational amplifiers of said switched capacitor circuit to odd-numbered/even-numbered vertical signal lines of a liquid crystal panel;

a liquid crystal panel circuit having a liquid crystal panel which is driven by said output selection circuit; and a vertical scanning circuit for driving horizontal lines of said liquid crystal panel, wherein said switched capacitor circuit has at least two operational amplifiers for capacitor ratio amplification which are input with the odd-numbered and even-numbered reference voltages through capacitors.

10. The liquid crystal driving circuit as claimed in claim 9, wherein each of said operational amplifiers of said switched capacitor sets a transistor at a differential input stage to an n-type channel and sets an output stage to a p-type channel when a positive-side voltage to the common voltage of said liquid crystal panel is output, and sets the transistor at the differential input stage to a p-type channel and sets the output stage to an n-type channel when a negative-side voltage to the common voltage of said liquid crystal panel is output.

11. The liquid crystal driving circuit as claimed in claim 9, wherein said gradation selection circuit selects and outputs one value through predetermined number of switches from predetermined number of divisional voltages into which a liquid crystal reference voltage is divided by resistance division in a gradation voltage generating circuit.

12. The liquid crystal driving circuit as claimed in claim 11, wherein each of said operational amplifiers of said switched capacitor sets a transistor at a differential input stage to an n-type channel and sets an output stage to a p-type channel when a positive-side voltage to the common voltage of said liquid crystal panel is output, and sets the transistor at the differential input stage to a p-type channel and sets the output stage to an n-type channel when a negative-side voltage to the common voltage of said liquid crystal panel is output.

* * * * *